US005503523A

United States Patent [19]

Prümper

[11] Patent Number: 5,503,523

[45] Date of Patent: Apr. 2, 1996

[54] TRANSMISSION-DRIVEN COMPRESSOR

[75] Inventor: Heinrich Prümper, Berlin, Germany

[73] Assignee: Deutsche Babcock-Borsig Aktiengesellschaft, Berlin, Germany

[21] Appl. No.: 303,384

[22] Filed: Sep. 9, 1994

[30] Foreign Application Priority Data

Nov. 16, 1993 [DE] Germany ..... 43 39 060.0

[51] Int. Cl.[6] ..... F04D 29/00; F04D 29/04

[52] U.S. Cl. ..... 415/168.2; 415/122.1; 415/229

[58] Field of Search ..... 415/122.1, 168.2, 415/229, 230

[56] References Cited

U.S. PATENT DOCUMENTS

| | | | |
|---|---|---|---|
| 2,625,883 | 1/1953 | Howser | 415/229 |
| 3,077,296 | 2/1963 | Ping, Jr. | 415/229 |
| 3,186,345 | 6/1965 | Ivanoff | 415/230 |
| 4,064,403 | 12/1977 | Miller | 415/229 |
| 4,439,096 | 3/1984 | Rockwood et al. | 415/230 |
| 5,319,273 | 6/1994 | Hockney et al. | 310/90.5 |

*Primary Examiner*—Edward K. Look
*Assistant Examiner*—Michael S. Lee
*Attorney, Agent, or Firm*—Max Fogiel

[57] ABSTRACT

A transmission-driven compressor for compressing oxygen. It has one or more stages (1–4) mounted on a rotor shaft (8) and accommodated in a housing (15). The shafts are driven by an integrated oil-lubricated transmission and rest in bearings (10) in another housing (5) that accommodates the transmission. The shafts also rest in additional bearings (18) in a stabilizing plate that the compressor housing is secured to and that is separated from the transmission housing (5) by atmosphere.

8 Claims, 4 Drawing Sheets

TRANSMISSION-DRIVEN COMPRESSOR

BACKGROUND OF THE INVENTION

The present invention concerns a transmission-driven compressor for compressing oxygen.

Oxygen has until now mainly been compressed in what are called classical multiple-stage single-shaft compressors with as many housings as necessary to obtain the desired output compression. Oxygen can, however, also be compressed in transmission-driven compressors specifically designed for the purpose. The oil employed to lubricate the bearings must be completely isolated from the oxygen to prevent explosions. The labyrinth seals between the bearings and the impellers must accordingly be axially elongated and multichambered. This tactic, however, disproportionally increases the overhang between the impeller's center of gravity and the midsection of the bearing, which unavoidably results in unbeneficial rotor dynamics. The rotating parts wobble and rub, raising the metal-ignition temperature at various points in the highly compressed oxygen atmosphere. The overall compressor, or at least the particular stage involved, can combust at such high temperatures. Transmission-driven compressors of this type and design are accordingly constantly at risk of burning.

SUMMARY OF THE INVENTION

The object of the present invention is to ensure isolation of the compressed oxygen from the lubricating oil along with beneficial rotor dynamics in a-transmission-driven compressor.

The transmission-driven compressor in accordance with the present invention accordingly includes space that communicates with the atmosphere between the transmission housing accommodating the lubricating oil and the compressor stage forwarding the oxygen. The space isolates the oxygen from the oil. Any oxygen escaping from the shaft seal in the compressor stages is immediately diluted and decompressed in the atmosphere to such an extent that it can not explode when it comes into contact with any oil that might escape. Mounting the rotor shafts in bearings in the stabilizing plate results in a much shorter overhang on the part of the impeller's center of gravity along with a thicker rotor shaft. The rotor dynamics are stabilized and wobble limited. The rotating parts will not rub in the oxygen space. The accordingly smooth and uniform impeller operation can be even further improved by using a magnetic bearing. The present invention makes it possible to fully exploit the advantageous properties of a transmission-driven compressor, specifically optimal stage-to-stage efficiency and effective controls, to compress oxygen.

BRIEF DESCRIPTION OF THE DRAWINGS

Several embodiments of the present invention will now be specified with reference to the accompanying drawing, wherein.

DESCRIPTION OF THE PREFERRED EMBODIMENTS

Figure 1:
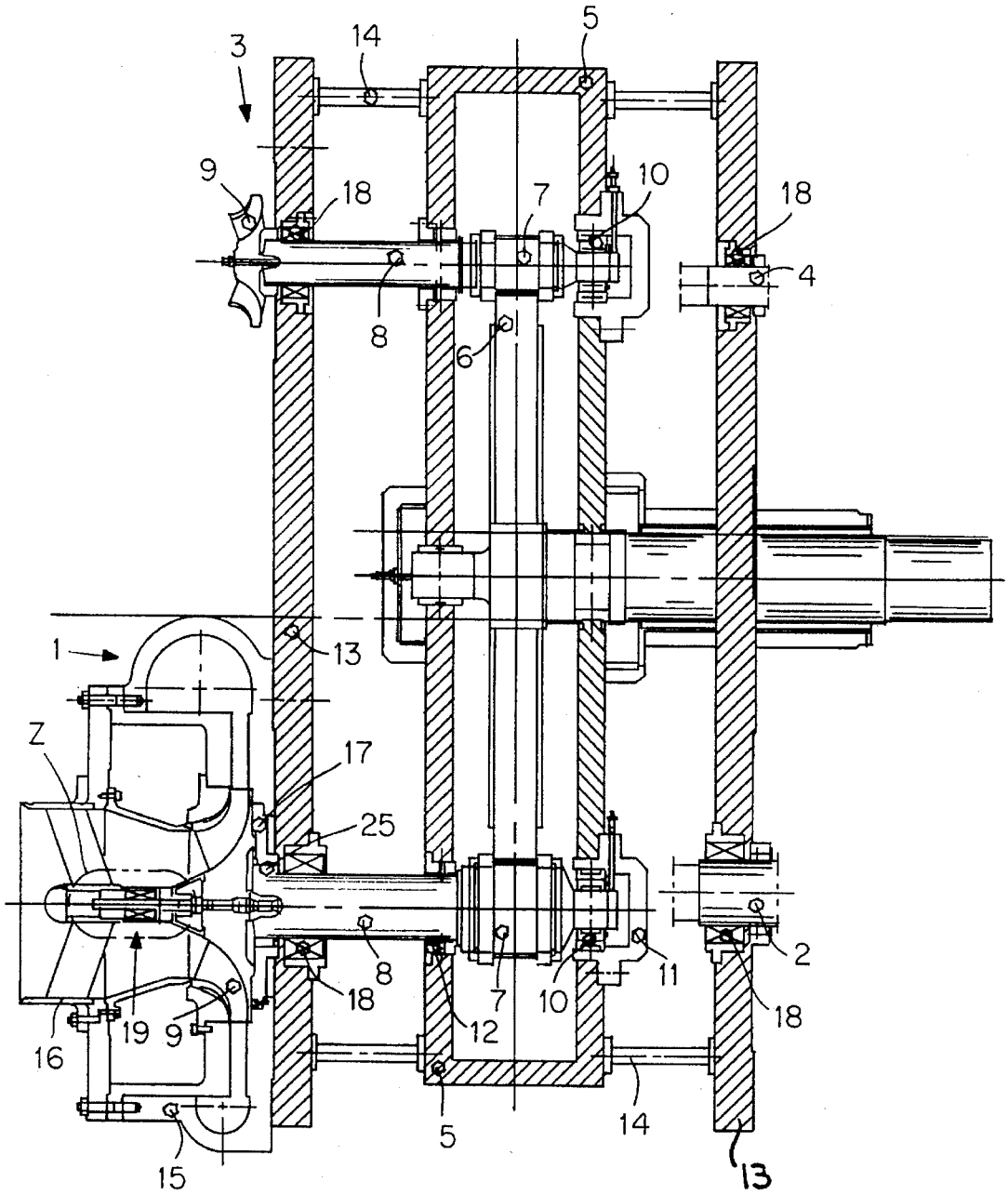
FIG. 1 is a longitudinal section through a transmission-driven compressor.
Figure 2:
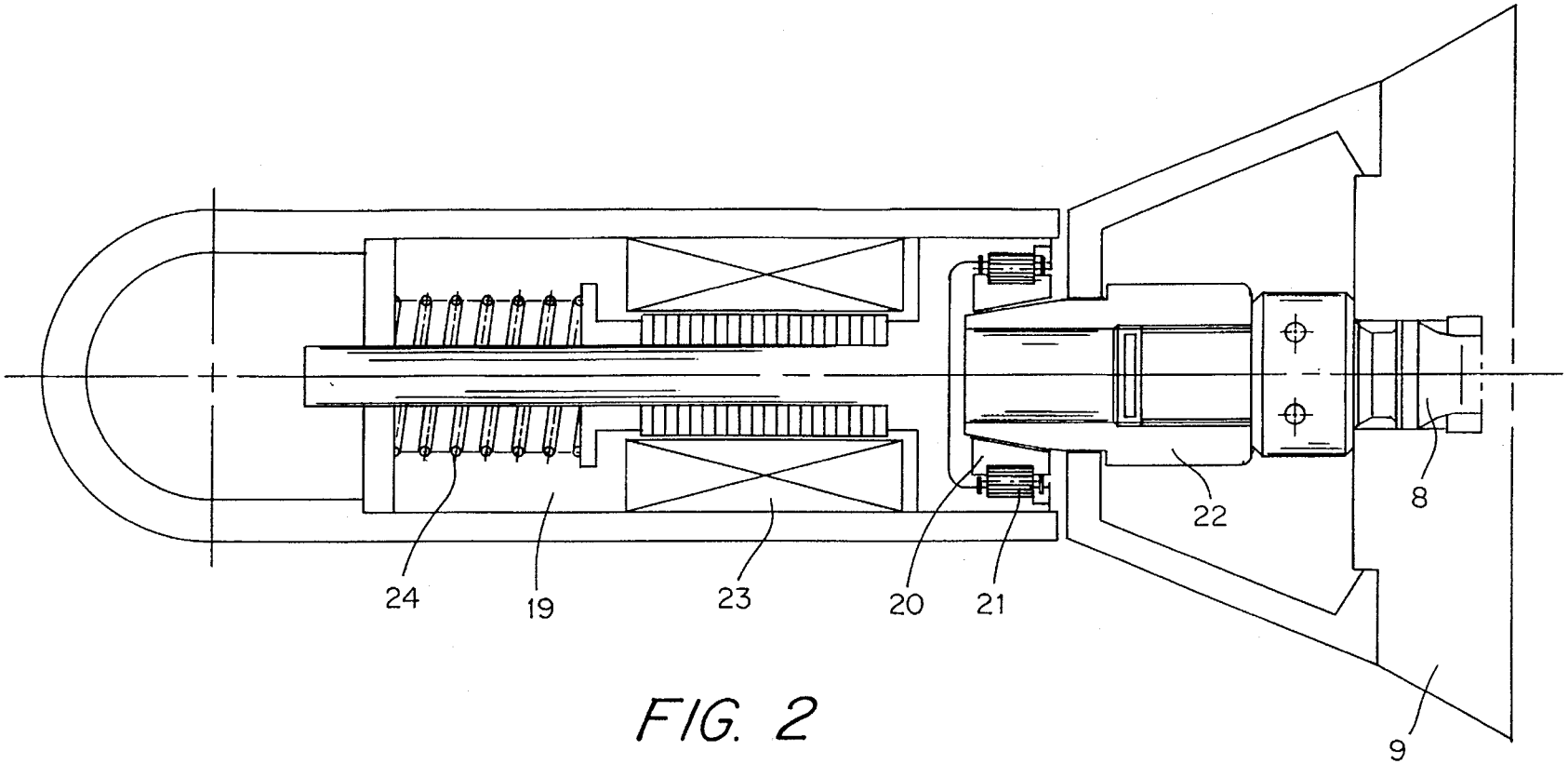
FIG. 2 is a larger-scale illustration of the detail Z in FIG. 1, and FIGS. 3 and 4 are longitudinal sections through other embodiments of a transmission-driven compressor.
Figure 3:
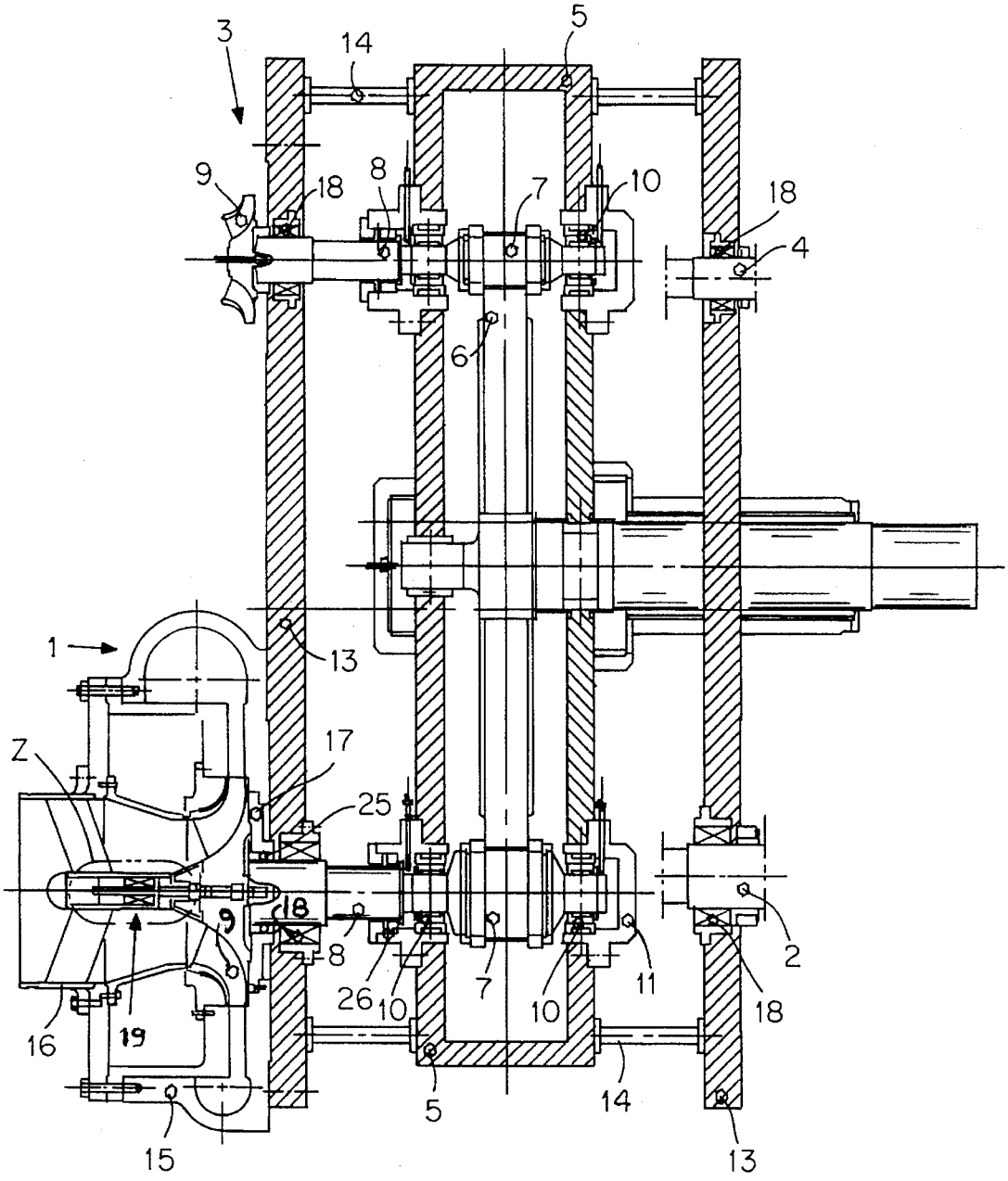

The transmission-driven compressor illustrated in FIG. 1 is employed for compressing oxygen and comprises four stages. Stages 1 and 3 are illustrated on the left, whereas stages 2 and 4 are only represented by truncated shafts.

Stages 1 through 4 are driven by an integrated oil-lubricated gear train. The gear train's housing 5 accommodates a central driving cogwheel 6 that engages pinions 7. Each pinion 7 is mounted on a rotor shaft 8. Mounted on the end of each shaft 8 remote from its pinion 7 is an impeller 9, one for each stage 1 through 4. The end of each shaft 8 remote from its impeller 9 is supported in an oil-lubricated tilting-segment bearing 10. Where it extends through housing 5, shaft 8 is sealed off from the atmosphere by a cap 11 on one side and on the other by an inflated shaft seal 12.

An independent stabilizing plate 13 is positioned on each side of and at some distance from housing 5. Stabilizing plates 13 are fastened to the housing by spacers 14 and rest along with it on an unillustrated base. Ambient air can accordingly flow between plates 13.

Each compressor stage 1 through 4 includes an impeller 9 that rotates inside a housing 15. Each compressor housing 15 has an intake 16 and is demarcated on the opposite side by a rear wall 17. Since each rear wall 17 is fastened to a stabilizing plate 13, the plates support compressor stages 1 through 4.

The rotor shaft 8 in each stage 1 through 4 extends through a stabilizing plate 13 and is secured in an additional bearing 18. Additional bearing 18 can be a hydraulic tilting-segment bearing lubricated with a material, water for example, compatible with oxygen.

Additional bearing 18 can also be a magnetic layer. Magnetic layers are known. They position shafts in variable magnetic fields. Rotor shaft 8 will rest accurately and self-center in such a magnetic bearing.

The compressor must be turned off in the event of failure on the part of the magnets, and rotor shaft 8 will be accommodated in a conical-trap backup bearing 19 in compressor-housing intake 16. Bearing 19 includes a conical bearing ring 20, rests on rollers 21, and encloses a conical section of the hub 22 of impeller 9. An electromagnet 23 maintains the bearing ring 20 in backup bearing 19 lifted off hub 22 against the force exerted by a spring 24. When the magnetic systems fails, electromagnet 23 becomes inactive and spring 24 will force bearing ring 20 against hub 22, allowing impeller 9 to coast to a stop without wobbling.

Rotor shaft 8 is sealed off from the atmosphere by a short shaft seal 25 in the rear wall 17 of compressor housing 15. Shaft seal 25 can be a dry ceramic floating-ring seal cushioned in gas. Leaking oxygen can be forwarded to an exhaust section along with the barrier air and safely allowed to escape into the shop. Rotors with much longer diameters can be sealed off in accordance with this principle than in oil-lubricated bearings.

Mounting rotor shaft 8 not only in an oil-lubricated bearing 10 in housing 5 but also in an additional bearing 18 in stabilizing plate 13 as hereintofore described will in conjunction with the use of only one impeller 9 for each shaft 8 ensure beneficial leverage in bearing 10. In one deviation from this principle on the other hand, rotor shaft 8 can additionally be mounted in another oil-lubricated bearing 26 accommodated in housing 5 on the other side of pinion 7. In this event the primary function of additional bearing 18 will be alignment and oscillation prevention, especially when a magnetic bearing is employed.

Figure 4:
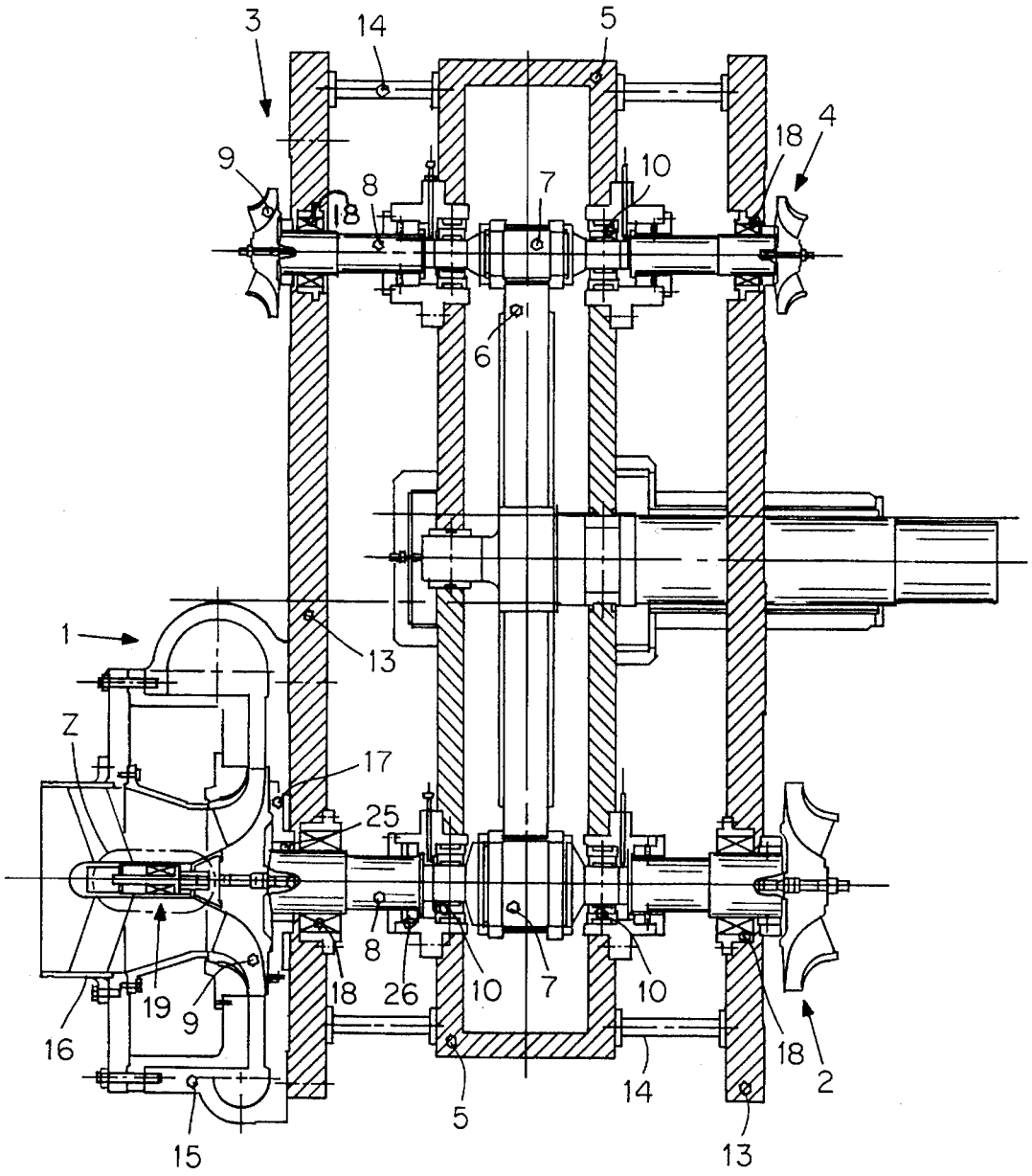

There are two impellers 9 on each rotor shaft 8, driven by a pinion 7, illustrated in FIG. 4. Behind each such impeller 9 is an additional bearing in the form of a magnetic bearing that acts as an alignment and oscillation-prevention mechanism.

Since each rotor shaft 8 is very near an impeller 9, the impeller's center of gravity has a very short overhang. Rotor shaft 8 is also thicker as facilitated by using a dry ceramic floating-ring seal 25 cushioned in gas to seal it. The short center-of-gravity overhang and the thicker shaft 8 render impeller 9 less likely to wobble, limiting the extent of oscillation and ensuring smoother operation. The large volume of atmosphere between oil-filled transmission housing 5 and oxygen-filled stages 1 through 4 ensures strict isolation of one fluid from the other. This approach diminishes the risk of conflagration, making the compressor safer to use for compressing oxygen. Such a compressor can of course also be employed for compressing gases other than oxygen when they must be guaranteed free of oil down to a few parts per million.

I claim:

1. A transmission-driven compressor for compressing oxygen, comprising: a first housing, at least one compressor stage in said first housing; a rotor shaft for mounting said stage; a second housing; first oil-lubricated bearings supporting said shaft; an integrated oil-lubricated transmission in said second housing for driving said shaft; second bearings in a stabilizing plate and also supporting said shaft, said stabilizing plate being secured to said first housing, said stabilizing plate being spaced from said second housing by atmosphere, lubricating oil of said first oil-lubricated bearings being separated from compressed oxygen for reducing dangers of explosions.

2. A transmission-driven compressor as defined in claim 1, wherein said second bearing is lubricated with a lubricant compatible with oxygen.

3. A transmission-driven compressor as defined in claim 1, wherein said second bearing is a magnetic bearing.

4. A transmission-driven compressor as defined in claim 1, including third oil-lubricated bearings, said shaft being supported by said first and third bearings in said second housing, said second bearing providing centering of said shaft and inhibiting oscillations.

5. A transmission-driven compressor as defined in claim 1, including two impellers on said rotor shaft; and a magnetic bearing behind each said impeller.

6. A transmission-driven compressor as defined in claim 1, wherein said stabilizing plate is secured to rear walls of said first housing.

7. A transmission-driven compressor for compressing oxygen, comprising: a first housing, at least one compressor stage in said first housing; a rotor shaft for mounting said stage; a second housing; first oil-lubricated bearings supporting said shaft; an integrated oil-lubricated transmission in said second housing for driving said shaft; second bearings in a stabilizing plate and also supporting said shaft, said stabilizing plate being secured to said first housing, said stabilizing plate being spaced from said second housing by atmosphere, lubricating oil of said first oil-lubricated bearings being separated from compressed oxygen for reducing dangers of explosions; said second bearing being a magnetic bearing; said stage having a hub; an impeller on said shaft; a conical-trap bearing positioned at said hub of said stage; said conical-trap bearing displacing axially for centering accurately said impeller when said magnetic bearing ceases operation.

8. A transmission-driven compressor for compressing oxygen, comprising: a first housing, at least one compressor stage in said first housing; a rotor shaft for mounting said stage; a second housing; first oil-lubricated bearings supporting said shaft; an integrated oil-lubricated transmission in said second housing for driving said shaft; second bearings in a stabilizing plate and also supporting said shaft, said stabilizing plate being secured to said first housing, said stabilizing plate being spaced from said second housing by atmosphere, lubricating oil of said first oil-lubricated bearings being separated from compressed oxygen for reducing dangers of explosions; said second bearing being a magnetic bearing; said stage having a hub; an impeller on said shaft; a conical-trap bearing positioned at said hub of said stage; said conical-trap bearing displacing axially for centering accurately said impeller when said magnetic bearing ceases operation; third oil-lubricated bearings, said shaft being supported by said first and third bearings in said second housing, said second bearing providing centering of said shaft and inhibiting oscillations; said shaft having two impellers mounted thereon; and a magnetic bearing behind each said two impellers.

* * * * *